US009030456B2

(12) United States Patent
Xiao et al.

(10) Patent No.: US 9,030,456 B2
(45) Date of Patent: May 12, 2015

(54) DRIVING DEVICE AND DRIVING METHOD FOR LIQUID CRYSTAL DISPLAY

(75) Inventors: Lu Xiao, Beijing (CN); Zhe Shi, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 340 days.

(21) Appl. No.: 13/345,930

(22) Filed: Jan. 9, 2012

(65) Prior Publication Data

US 2012/0176359 A1 Jul. 12, 2012

(30) Foreign Application Priority Data

Jan. 10, 2011 (CN) ..... 2011 1 0004038

(51) Int. Cl.
*G09G 3/36* (2006.01)

(52) U.S. Cl.
CPC ..... *G09G 3/3688* (2013.01); *G09G 2310/061* (2013.01); *G09G 3/3677* (2013.01); *G09G 2310/0248* (2013.01); *G09G 2310/0251* (2013.01); *G09G 2320/0261* (2013.01); *G09G 2330/021* (2013.01)

(58) Field of Classification Search
CPC ..... G09G 2320/0261; G09G 3/3677; G09G 3/3668; G09G 2330/023; G09G 2330/021; G09G 2310/061; G09G 2310/0248; G09G 2310/0251
See application file for complete search history.

(56) References Cited

U.S. PATENT DOCUMENTS

| | | | | |
|---|---|---|---|---|
| 2006/0262071 | A1* | 11/2006 | Shieh et al. | 345/100 |
| 2009/0027322 | A1 | 1/2009 | Hosotani | |
| 2009/0040173 | A1 | 2/2009 | Ezaki et al. | |
| 2009/0146934 | A1* | 6/2009 | Hong et al. | 345/87 |
| 2009/0225066 | A1 | 9/2009 | Sawahata | |
| 2009/0303166 | A1* | 12/2009 | Tsubata | 345/87 |
| 2010/0177089 | A1* | 7/2010 | Huang | 345/214 |
| 2011/0063278 | A1* | 3/2011 | Han | 345/212 |

FOREIGN PATENT DOCUMENTS

| | | | |
|---|---|---|---|
| CN | 101305410 | A | 11/2008 |
| CN | 101390151 | A | 3/2009 |

OTHER PUBLICATIONS

First Chinese Office Action dated Apr. 23, 2013; Appln. No. 201110004038.2.
Second Chinese Office Action dated Dec. 27, 2013; Appln. No. 201110004038.2.

* cited by examiner

*Primary Examiner* — Gerald Johnson
*Assistant Examiner* — Maheen Javed
(74) *Attorney, Agent, or Firm* — Ladas & Parry LLP

(57) ABSTRACT

A liquid crystal display of a charge sharing mode comprises a control device for turning on the gates on the gate line in the black frame insertion timing. Each gate line of the liquid crystal display panel is connected with the control device. In the black insertion timing, the control device outputs to the gate line connected thereto a first control signal for controlling the gates on the gate line to be turned on, and the black frame insertion timing is a time when charge sharing is conducted among data lines from the gates on the gate line are turned off in the current frame until they are turned on in the next frame.

5 Claims, 9 Drawing Sheets

DRIVING DEVICE AND DRIVING METHOD FOR LIQUID CRYSTAL DISPLAY

BACKGROUND

Embodiments of the present disclosed technology relate to a driving device and a driving method for a liquid crystal display (LCD).

A phenomenon of motion blur, which is known as "image trailing" or "after image", will occur when a general thin film transistor liquid crystal display (TFT-LCD) displays a fast moving image. Generally, it refers to a phenomenon in which the edge of the profile of the image blurs in the image transition process. There are two reasons for the occurrence of the phenomenon of the motion image blur, one is the excessive long response time of the liquid crystal (LC), and the other is continuous driving of the thin film transistor (TFT).

Currently, the frequency doubling technology is mostly used to raise the frame frequency from 60 Hz to 120 Hz, in which black frames or motion compensation frames are interpolated between the original frames to prevent the occurrence of the motion blur phenomenon when the liquid crystal display displays a fast moving image. In the frequency doubling technology, it requires a memory with a relatively large storage capacity, and thus of a relatively high cost. Therefore, how to improve the motion blur phenomenon occurring when the TFT-LCD displays a fast moving image with a low cost is an urgent problem to be solved.

SUMMARY

The present disclosure provides a driving device and a driving method for a liquid crystal display, which realizes the improvement of the motion blur phenomenon occurring when the TFT-LCD displays a fast moving image with a low cost.

An embodiment of the disclosed technology provides a driving device for a liquid crystal display, which is used for liquid crystal display of a charge sharing mode and comprises a control device for controlling the gates on the gate line to be turned on in a black frame insertion timing. Each gate line of the liquid crystal display is connected with the control device. The control device outputs to a gate line connected thereto a first control signal for controlling gates on the gate line to be turned on in a black frame insertion timing, wherein the black frame insertion timing is a timing at which charge sharing is conducted among data lines during a period from the gates on the gate line are turned off in a current frame until they are turned on in a next frame.

In an example, the control device comprises an AND gate, the first input terminal of which is connected to a timing controller, and the second input terminal of which is connected to a gate turn-on signal output terminal, and the AND gate provides the first control signal to its corresponding gate line according to a first timing signal input from the timing controller and the gate turn-on signal input from the gate turn-on signal output terminal.

Further, in an example, in order to save cost, the control device connected to each gate line comprises an OR gate, the first input terminal of which is connected to the output terminal of the AND gate, the second input terminal of which is connected to a output terminal for providing a second control signal to each gate line, and the output terminal of the OR gate is connected to its corresponding gate line. The second control signal controls the gates on each gate lines to be turned on row by row in a charge sharing mode, and the first timing signal is a timing signal for controlling the charge sharing act.

Another embodiment of the disclosed technology provides a driving method for a liquid crystal display, which is used for a liquid crystal display of a charge sharing mode, comprises: inputting a driving voltage for turning on a gate to the gate line of the L-th row in a black frame insertion timing, which is timing when charge sharing is conducted among data lines from the gates on the gate line of the L-th row are turned off in the current frame until they are turned on in the next frame, wherein, $1<L\leq N$, N is the total number of the gate lines of the liquid crystal display panel, and L is an integer.

In an example, the step of inputting a driving voltage for turning on a gate to the gate line of the L-th row in the BFI time comprises: after the gates on the gate line of the (M−1)-th row are turned off, and before the gates on the gate line of the M-th row are turned on, inputting the driving voltage for turning on a gate to the gate line of the L-th row, turning on the gate line of the L-th row, and neutralizing the source data of the L-th row of the liquid crystal display panel by charge sharing to become a common electrode voltage; wherein, $1\leq M\leq N$, N is the total number of the gate lines of the liquid crystal display panel, M is an integer, and the gate line of the M-th row is the gate line whose gate is turned on after the gate line of the L-th row.

In the driving device and the driving method for the liquid crystal display provided by the embodiments of the present disclosed technology, in the condition of charge sharing among data lines, gate line of each row of the liquid crystal display is turned on in its corresponding black frame insertion timing, the source data corresponding to gate line of each row of the liquid crystal display panel is neutralized in the black frame insertion timing to approximate the common electrode voltage, so that the display effect of this row is equivalent to that when black data is inserted. In this way, the gate line of a row has displayed a black image for a period of time when the source data corresponding to this row arrives in the next frame, thereby realizing the screen-refreshing effect and improving the motion blur phenomenon of the liquid crystal display panel.

Further scope of applicability of the present disclosed technology will become apparent from the detailed description given hereinafter. However, it should be understood that the detailed description and specific examples, while indicating preferred embodiments of the disclosed technology, are given by way of illustration only, since various changes and modifications within the spirit and scope of the disclosed technology will become apparent to those skilled in the art from the following detailed description.

BRIEF DESCRIPTION OF THE DRAWINGS

The present disclosed technology will become more fully understood from the detailed description given hereinafter and the accompanying drawings which are given by way of illustration only, and thus are not limitative of the present disclosed technology and wherein:

FIG. 4(*b*) is a timing chart for realizing charge sharing in the liquid crystal display shown in FIG. 3;

FIG. 9(*b*) is a timing chart for the liquid crystal display shown in FIG. 9(*a*);

FIG. 10(*b*) is a timing chart for the liquid crystal display shown in FIG. 10(*a*).

DETAILED DESCRIPTION

In the following, the technical solutions of the embodiments of the present disclosed technology will be described clearly and thoroughly with reference to the figures for the embodiments of the present disclosed technology. Obviously, the described embodiments are only a part of, but not all, embodiments of the present disclosed technology. All other embodiments obtained based on the embodiments of the present disclosure by those of ordinary skill in the art without inventive labor shall fall within the protection scope of the present disclosed technology.

In order to realize the improvement of the motion blur phenomenon occurring when a TFT-LCD displays a fast moving image with a low cost, the embodiments of the present disclosed technology provide a driving device and a driving method for a liquid crystal display.

Figure 1:
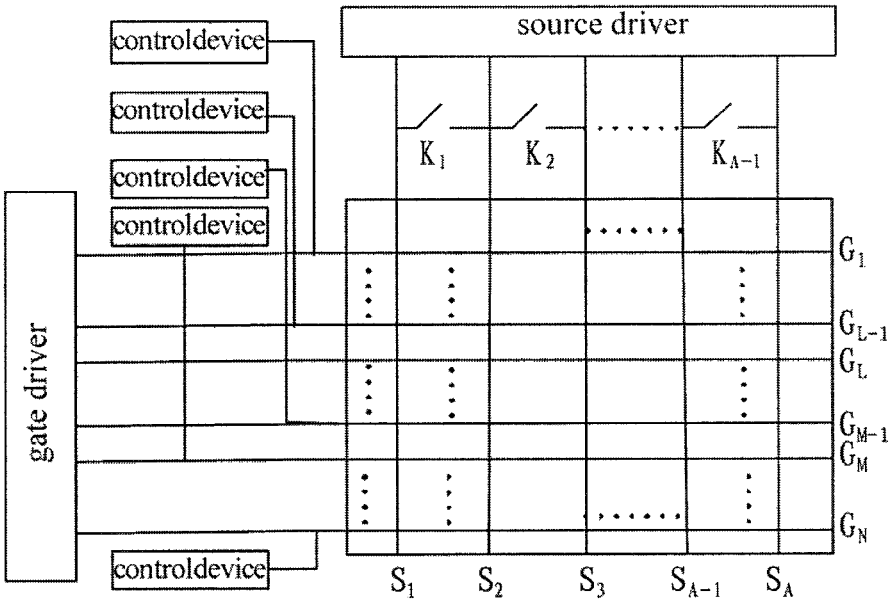
FIG. 1 is a structural schematic diagram of a driving device for a liquid crystal display provided by an embodiment of the present disclosed technology.

As shown in FIG. 1, the driving device for the liquid crystal display provided by an embodiment of the present disclosed technology is used for a liquid crystal display of a charge sharing mode, the driving device comprising a gate driver and a source driver. The liquid crystal display comprises a liquid crystal display panel on which multiple gate lines G1, G2 . . . , multiple data lines S1, S2 . . . , and multiple thin film transistors (not shown) are disposed. The gates of the TFTs are connected to the adjacent gate lines G1, G2 . . . , and the sources of the TFTs are connected to the adjacent data lines S1, S2 . . . . The gate lines G1, G2 . . . are connected to the output terminals of the gate driver through control devices. The data lines S1, S2 . . . are connected to the source driver. A charge sharing device K1, K2 . . . is connected between two adjacent data lines.

The driving device for the liquid crystal display further comprises control devices to control the gates on the gate lines to be turned on at the time of Black Frame Insertion (BFI). Each gate line of the liquid crystal display panel is connected with the control device, which outputs a first control signal to the gate line connected thereto so as to control the gates on the gate line to be turned on in the BFI time. The BFI time is a time when the charge sharing is conducted among the data lines from the gates on the gate line is turned off in the current frame until they are turned on in the next frame and.

Figure 2:
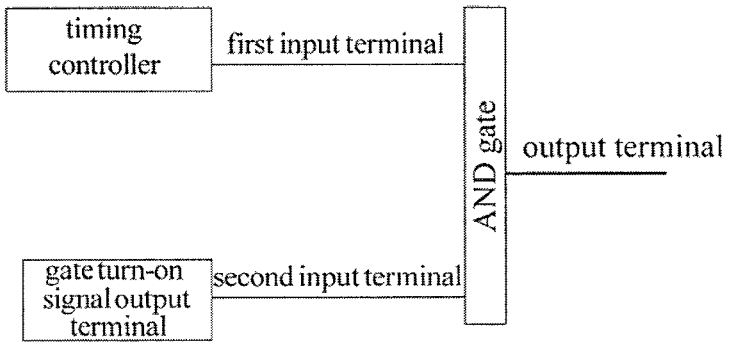
FIG. 2 is a first structural schematic diagram of a control device in the driving device for the liquid crystal display provided by the embodiment of the present disclosed technology.

In particular, as shown in FIG. 2, the control device connected to each gate line comprises an AND gate, the first input terminal of which is connected to a timing controller, and the second input terminal of which is connected to a gate turn-on signal output terminal. The AND gate provides the first control signal at the output terminal thereof to its corresponding gate line according to the first timing signal input at the first input terminal and the gate turn-on signal input at the second input terminal.

The driving device for the liquid crystal display provided by the embodiment of the present disclosed technology is of a charge sharing mode, in which a charge sharing device is disposed at the source data output terminal of the source driver. It is possible for the charge sharing device to neutralize the source data output from the source data output terminal of the source driver to approximate the common electrode voltage when conducting charge sharing act. Then, on the basis of the charge sharing mode, each gate line of the liquid crystal display panel is made to be turned on in the corresponding BFI time. The source data corresponding to each gate line of the liquid crystal display panel is neutralized to approximate the common electrode voltage in the BFI time, so that the display effect of this row is equivalent to that when black data is inserted therein. In this way, the gate line of this row has displayed a black image for a period of time when the source data corresponding to this row arrives in the next frame, thereby realizing the screen-refreshing effect and improving the motion blur phenomenon of the liquid crystal display panel.

In order to make those skilled in the art better understand the liquid crystal display of a charge sharing mode provided by the embodiment of the present disclosed technology, a detailed description will be made hereinafter to the liquid crystal display of the charge sharing mode.

The liquid crystal display of the charge sharing mode provided by the embodiment of the present disclosed technology comprises the liquid crystal display panel, the timing controller, the source driver and the gate driver. The timing controller outputs the timing control signal to the source driver and the gate driver.

Figure 3:
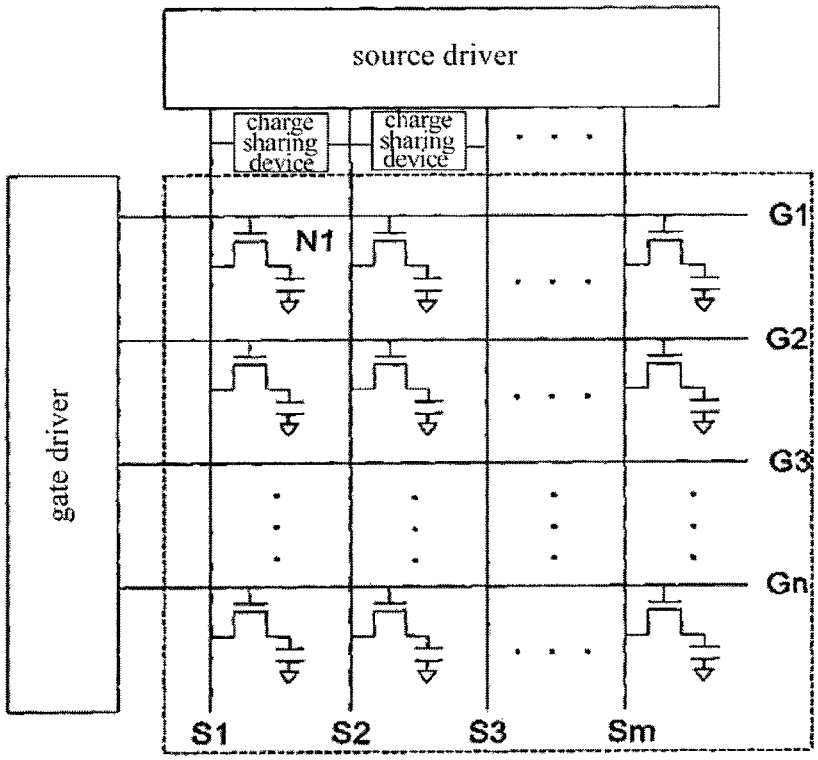
FIG. 3 is a second structural schematic diagram of a control device in the driving device for the liquid crystal display provided by the embodiment of the present disclosed technology.

As shown in FIG. 3, multiple TFTs N1, multiple gate lines G1, G2 . . . , and multiple data lines S1, S2 . . . separated from each other are disposed on the liquid crystal display panel. The gate, source and drain of each TFT N1 are connected to the adjacent gate line, data line and pixel electrode (not shown in the figure) respectively. The gate line is connected to the output terminal of the gate driver, and the data line is connected to the output terminal of the source driver. Here the liquid crystal display panel selectively turns on the gate lines in a row sequential driving manner. When a certain gate line is selected, the polarity of the source data output on the data line by the source driver is inverse to the polarity of the source data output on the data line by the source driver when the gate line is selected last time, and the source driver outputs source data with different polarities on two adjacent data lines. In the above mentioned driving manner, a charge sharing device may be disposed between any two adjacent output terminals of the source driver, and it is possible to control the act of the charge sharing devices and the selection of the gate lines by corresponding timings to realize the charge sharing, thereby reducing the power consumption of the source driver.

Figure 4A:
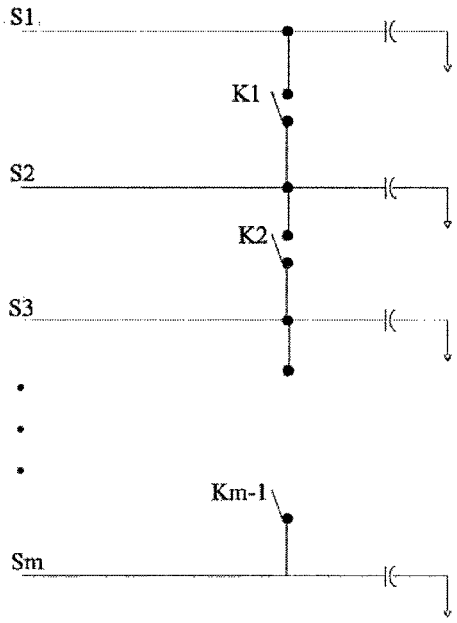
FIG. 4(*a*) is a structural schematic diagram of a charge sharing device in the liquid crystal display shown in FIG. 3.
Figure 4B:
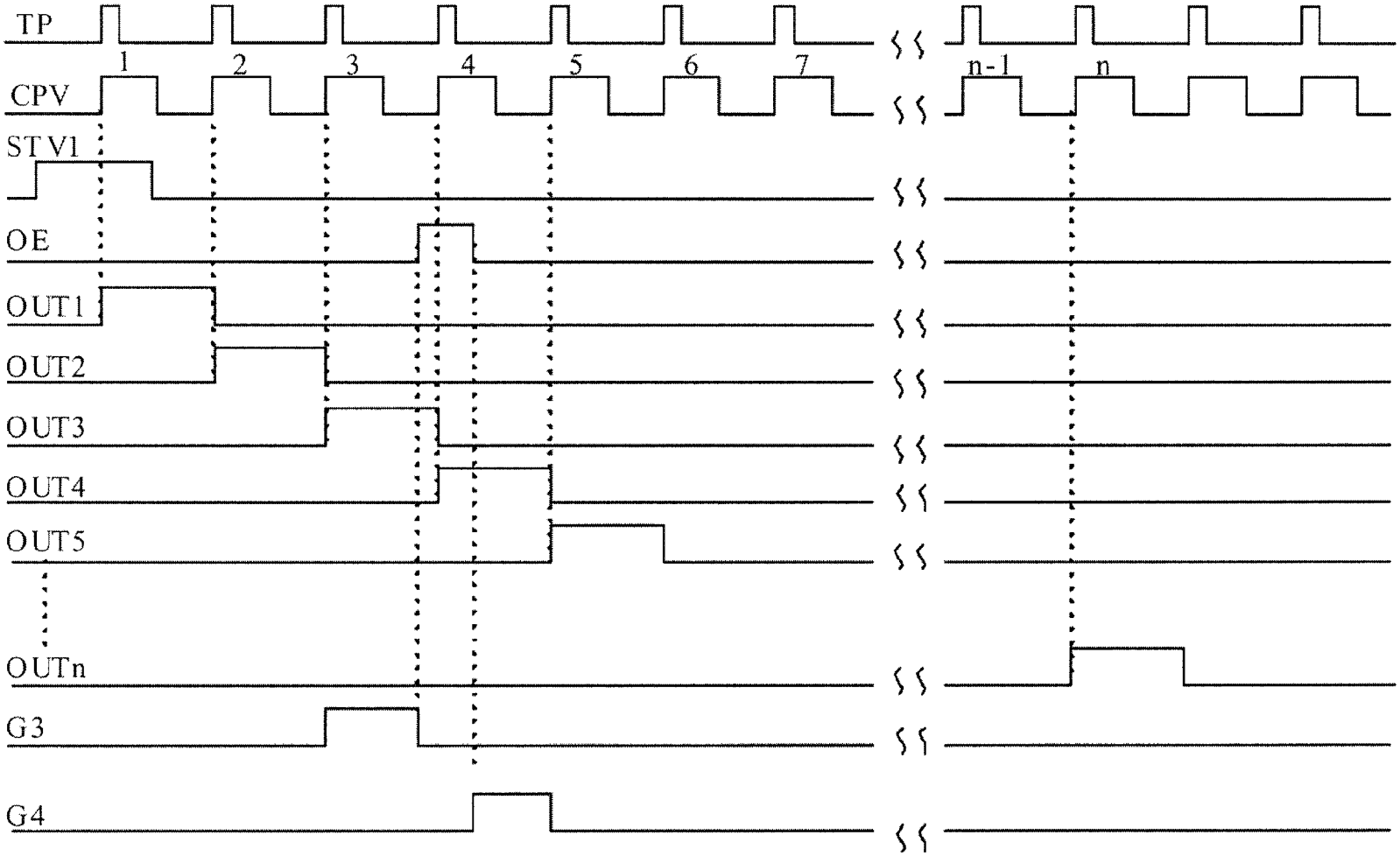

In particular, as shown in FIGS. 4(*a*) and 4(*b*), the data sharing device may be switch circuits K1, K2 . . . .

In FIG. 4(*b*), TP is a latch output signal provided by the timing controller. The rising edge of the TP controls a source data latch in the source driver to latch the source data, while controlling the charge sharing device to conduct charge sharing act. The falling edge of the TP controls a source output control circuit in the source driver to output the source data from a source data buffer onto the liquid crystal display panel. In detail, the acts for controlling the charge sharing device to conduct charge sharing are as follows. The switch circuits disposed between the adjacent output terminals of the source driver are turned on. That is, when TP is at the rising edge, the source data latch in the source driver latches the source data, and the switch circuits K1, K2 . . . are turned on to conduct the charge sharing act, so that the source data output from the source data output terminal of the source driver is neutralized to approximate the common electrode voltage.

CPV is a clock signal provided by the timing controller, and used as a reference clock for signals such as TP, STV, OE and OUT1~OUTn etc.

STV is a frame turn-on signal provided by the timing controller.

OE is a low level enabling signal provided by the timing controller. The rising edge of OE is before the rising edge of TP, and the falling edge of OE is after the falling edge of TP.

OUT1~OUTn provided by the gate driver are the gate turn-on signals for the first row to the last row, and are output from the gate turn-on signal output terminal of the gate driver.

Figure 5:
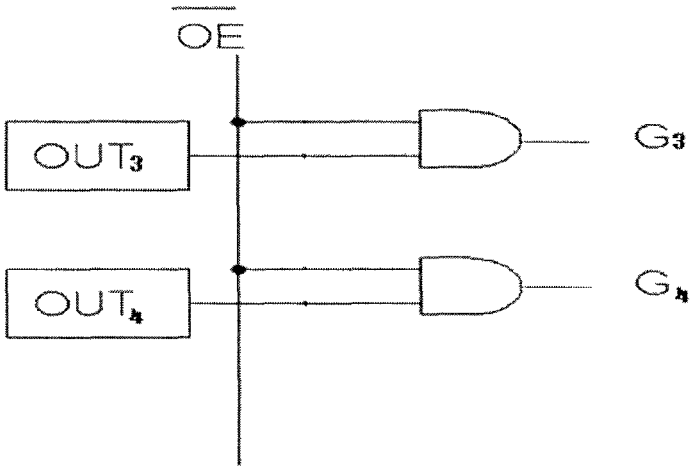
FIG. 5 is a circuit diagram of the logic gates for realizing charge sharing in the liquid crystal display shown in FIG. 3.

Now, as an example, descriptions will be made with reference to a case in which the charge sharing act is conducted before the gate line of the fourth row is ready to be selected sequentially after the gate line of the third row has been selected sequentially. The rising edge of TP controls the charge sharing device to start conducting the charge sharing act. OUT3 and OUT4 provide gate turn-on signals to the gate lines of the third row and the fourth row. In order to prevent the source data on the gate line of the third row from being washed out due to the charge sharing act and the image quality from being affected due to the non-readiness of the source data on the gate line of the fourth row, the driving signals G3 and G4 output from the output terminals of the gate drivers are obtained from OE in combination with OUT3 and OUT4. In particular, as shown in FIG. 5, the gate turn-on signal output terminal is connected to the first input terminal of the AND gate, the other input terminal of the AND gate is connected to the OE low level enabling signal output terminal, the output terminal of the AND gate is used as the second control signal output terminal of the gate driver to control the gates on each gate line to be turned on row by row in the charge sharing mode, whereby, $$G3=\mathrm{OUT}3*\overline{OE};\ G4=\mathrm{OUT}4*\overline{OE}.$$

With reference to FIG. 4(*b*), it can be known that the gate turn-on signals OUT3 and OUT4 are activated with the low level of OE.

Therefore, the gates on the gate line of the third row will be turned off in advance at the rising edge of OE, to avoid the gates on the gate line of the third row not being turned off when the charge sharing act starts and thereby the source data of the third row of the liquid crystal display panel being washed out, wherein the source data of the third row is provided by the source driver.

Also, the turning on of the gate on the gate line of the fourth row is delayed at the falling edge of OE, to ensure that the gate on the gate line of the fourth row will not be turned on until the charge sharing act is over and the source driver has output valid source data. In this way, the valid source data has been ready and input to the liquid crystal display when the gate on the gate line of the fourth row is turned on, thereby guaranteeing the image quality.

It can be known from OUT3 and OUT4 that all gates are turned off during the charge sharing period, i.e. the period when the corresponding TP is of a high level. Therefore, only the charge sharing is conducted at the output terminal of the source driver, and the drains of the TFTs are not affected, that is, the stored data of the liquid crystal display panel is not affected.

Figure 6:
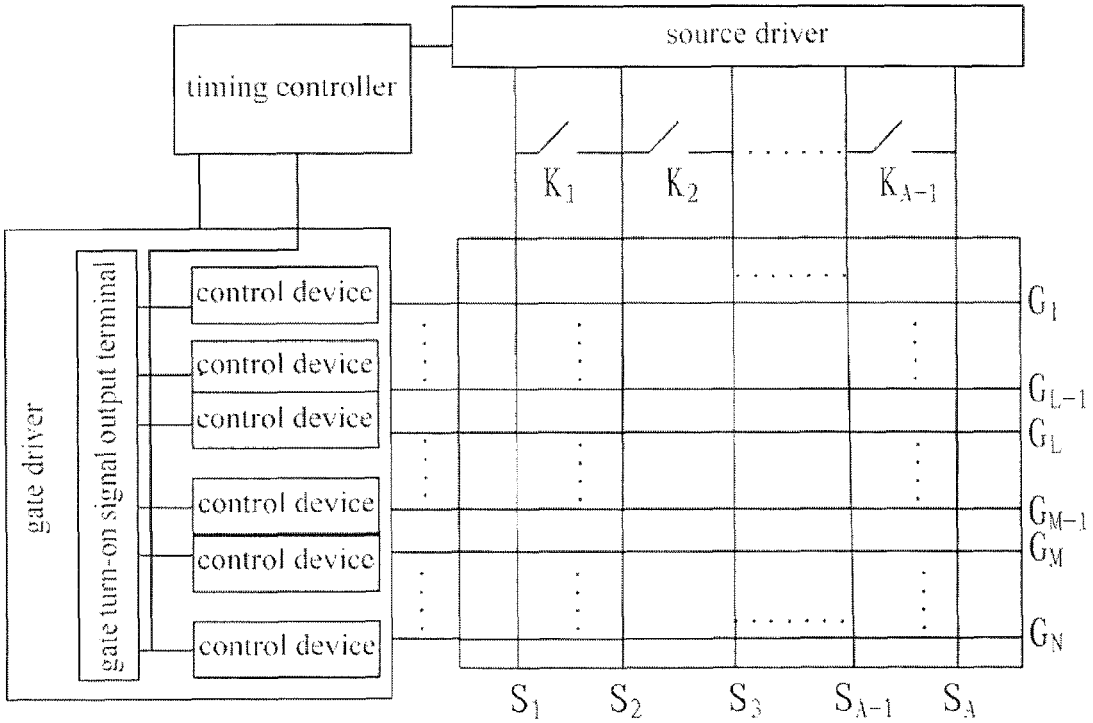
FIG. 6 is a structural schematic diagram of a driving device for a liquid crystal display provided by another embodiment of the present disclosed technology.

The above is only one of the charge sharing technologies. On the basis of the above charge sharing technology, a liquid crystal display of a charge sharing mode provided by another embodiment of the present disclosed technology is configured with a source driver, a gate driver, a timing controller, a control device and a liquid crystal display panel, as shown in FIG. 6. The liquid crystal display panel comprises multiple gate lines $G_1$~$G_N$, multiple data lines $S_1$~$S_A$ and multiple liquid crystal units. The liquid crystal unit comprises TFTs, the gate and source of which are connected to the adjacent gate line and data line respectively. The output terminal of the source driver is coupled to the data line, the output terminal of the gate driver is coupled to the gate line, and charge sharing devices $K_1$~$K_{A-1}$ are disposed at the output terminal of the source driver.

Figure 7:
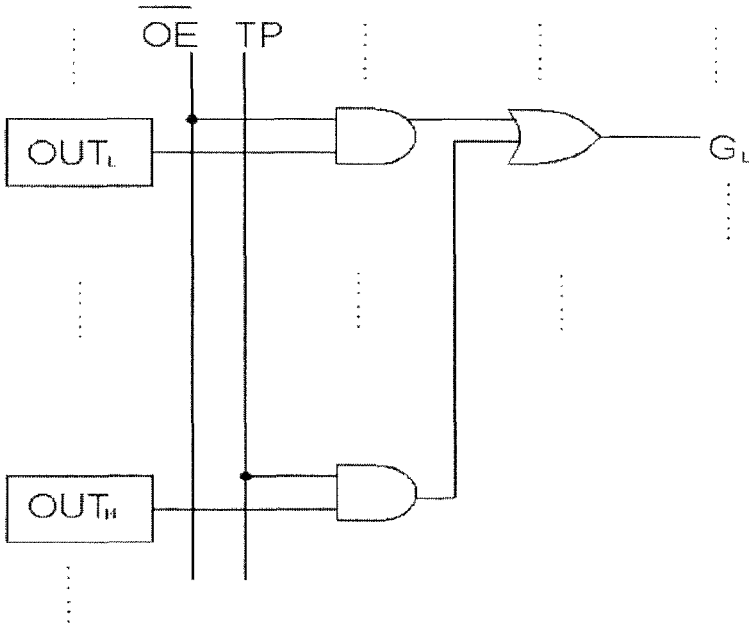
FIG. 7 is a first circuit diagram of a control device in the liquid crystal display shown in FIG. 6.

In the present embodiment, the above mentioned OE, TP, STV, OE and CPV signals are provided by the timing controller. Preferably, the TP signal, the OE signal and the gate turn-on signal provided by the timing controller provide the gate line selection signals $G_1$~$G_N$ to the gate lines $G_1$~$G_N$ through the control devices. The control devices can be disposed outside of the driver, or alternatively inside of the driver. In particular, it can be implemented by the logic gate circuits as shown in FIG. 7, wherein, the gate line selection signal is:

$$G_L=\mathrm{OUT}_L*\overline{OE}+\mathrm{OUT}_M*TP(1\leq M\leq N, 1\leq L\leq N, L\neq M)$$

Figure 8:
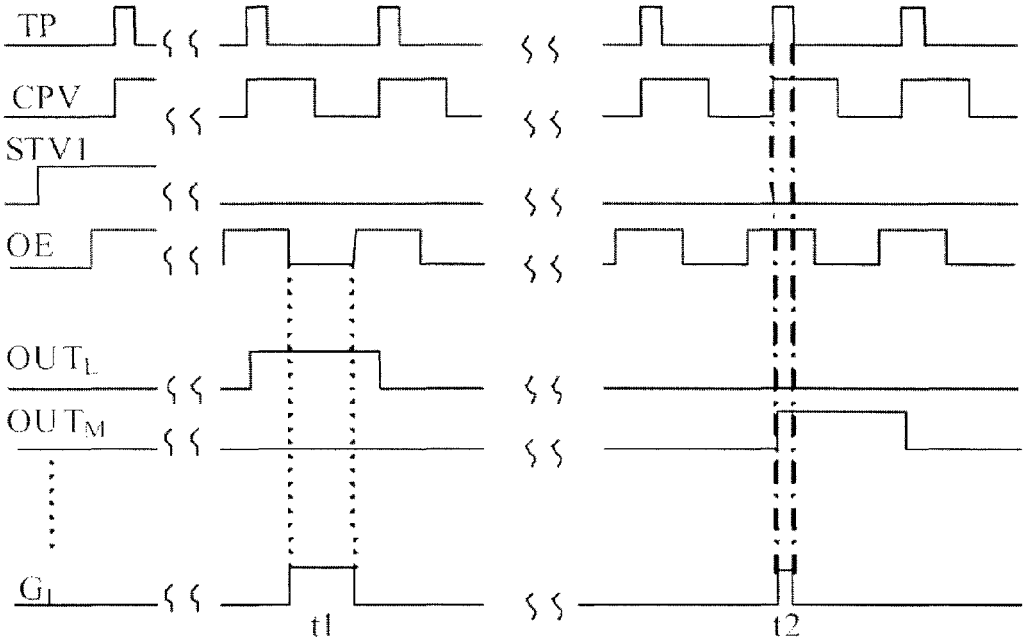
FIG. 8 is a first timing chart for the liquid crystal display shown in FIG. 7.

The control device comprises an AND gate and an OR gate. The first input terminal of the AND gate is connected to the signal output terminal of the timing controller for controlling the charge sharing act among the data lines. In the present embodiment, the signal output terminal of the timing controller for controlling the charge sharing act among the data lines is the TP signal output terminal. The second input terminal of the AND gate is connected to the gate turn-on signal output terminal of the M-th row of the gate driver, which outputs a signal of $\mathrm{OUT}_M$ for controlling the gates on the gate line of the M-th row to be turned on. The output terminal of the AND gate is connected to the first input terminal of the OR gate. The second input terminal of the OR gate is connected to the second control signal output terminal of the L-th row of the gate driver, the second control signal output terminal of the L-th row outputting a signal of $\mathrm{OUT}_L*\overline{\mathrm{OE}}$, which is a signal output by the gate turn-on signal output terminal according to an enable signal. Here, the enable signal is a low level enabling signal. The output terminal of the OR gate is connected to the gate line of the L-th row of the liquid crystal display panel to control the gates on the gate line of the L-th row to be turned on row by row in the charge sharing mode and turned on in the BFI time. With reference to FIG. 8, with the logic gate circuit as shown in FIG. 7, the gates on the gate line of the L-th row can be turned on in the time t1 and t2. The gates are turned on in the time t1 to display the source data of the L-th row of the liquid crystal display panel and achieve the purpose of image display. The implementation is mostly the same as the above mentioned charge sharing technique, and will not be described here. The gates on the gate line of the L-th row are turned on in the time t2 to wash out the source data displayed on the L-th row of the liquid crystal display panel, so that in the time t2, the display effect of the L-th row of the liquid crystal display panel is equivalent to that when black data is inserted. The time t2 is the above mentioned BFI time. The value of t2 can be set as required. The larger the value of t2, the longer the keeping time of the data of the last frame, and the shorter the keep time of the black data. Therefore, generally, the keep time of the data of the last frame should be increased as much as possible, provided the screen-blacking effect is guaranteed. In particular, the setting of t2 can be realized by the setting of the number of rows between the gate line of the L-th row and the gate line of the M-th row.

Now a detailed description will be made to the setting of the time t2, which comprises, but not limited to, the following implementation.

Figure 9A:
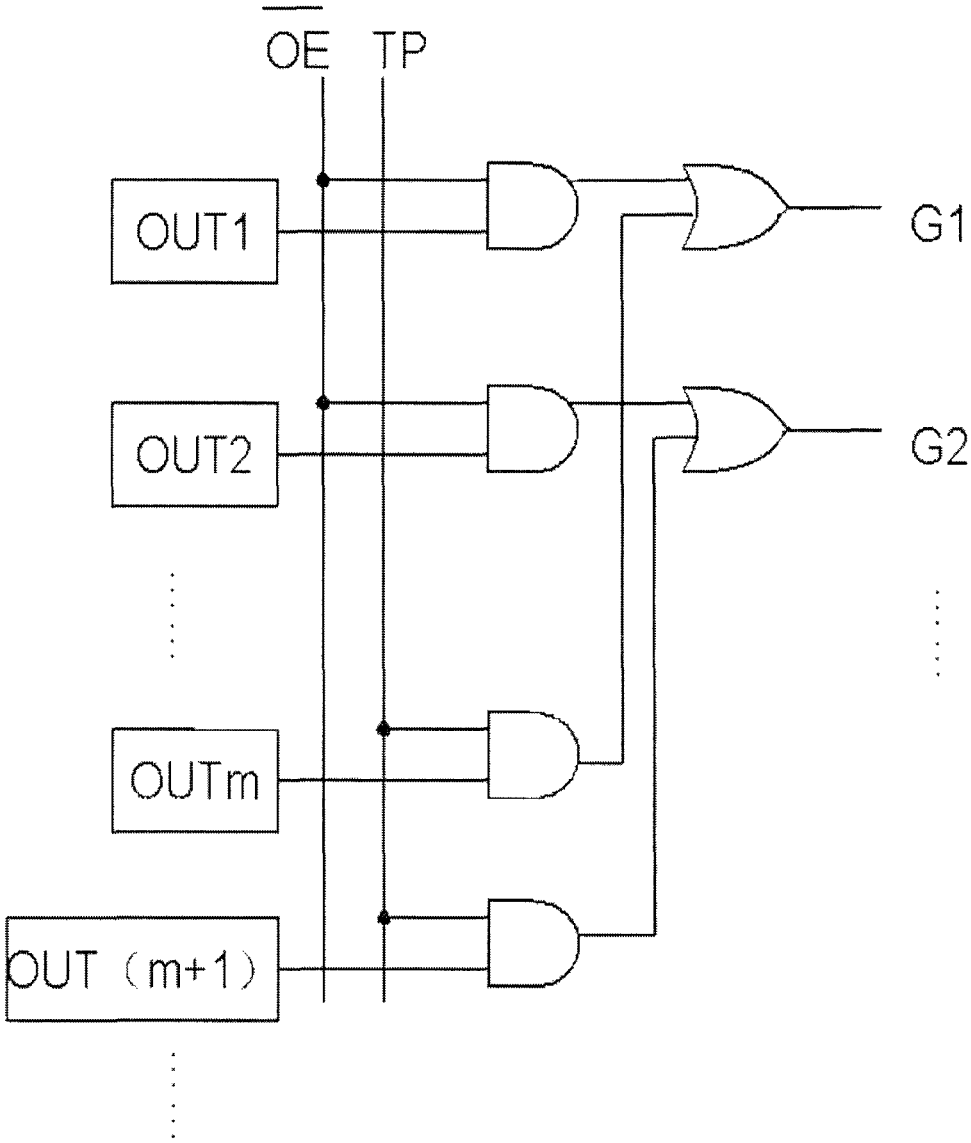
FIG. 9(*a*) is a second circuit diagram of the control device in the liquid crystal display shown in FIG. 6.
Figure 9B:
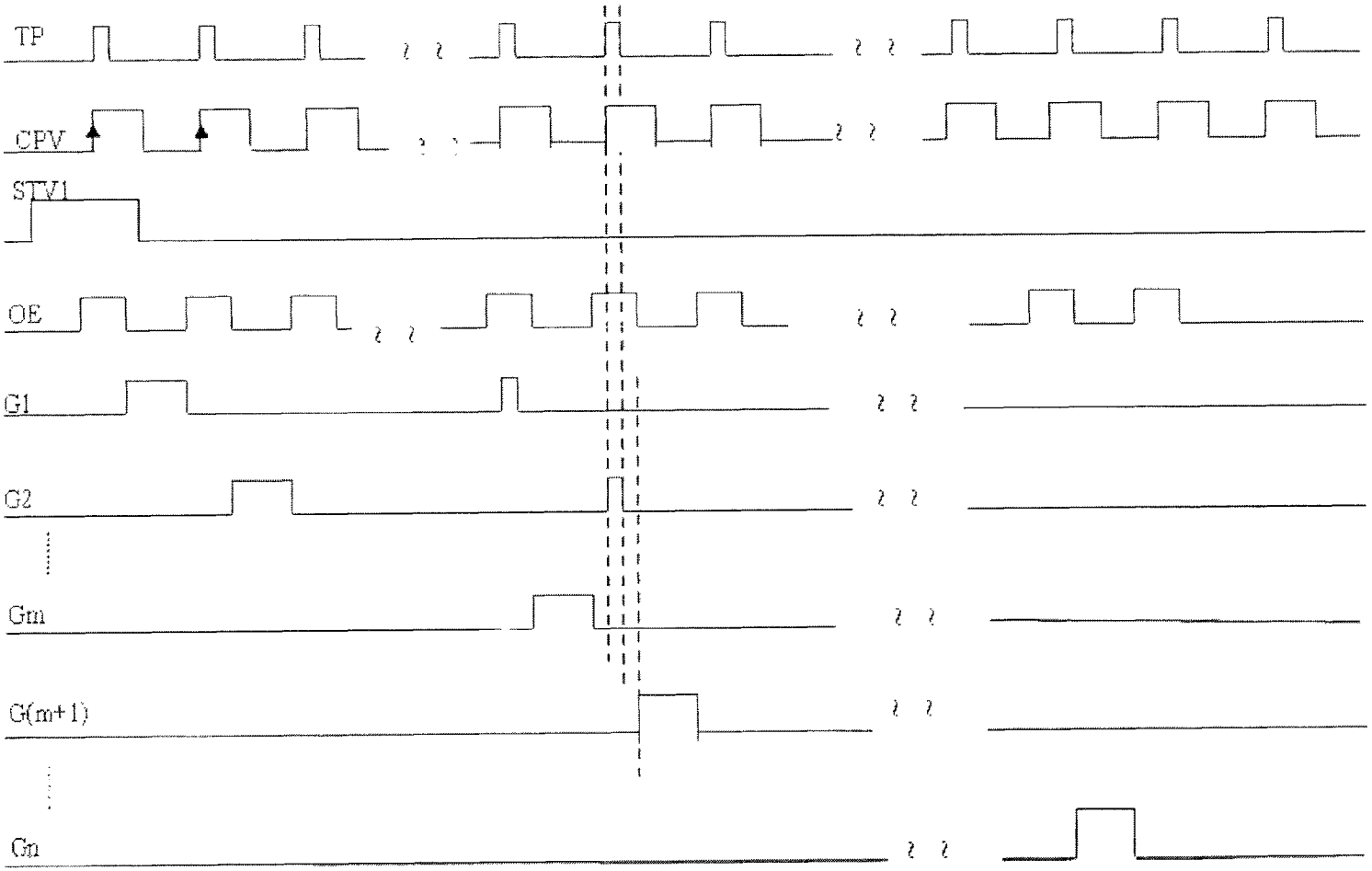

(1) As shown in FIGS. 9(*a*) and 9(*b*), the number of gate lines between the gate line of the L-th row and the gate line of the M-th row is set to be (m−1), wherein m>1. The detailed implementation is as follows. Before the (m+1)-th row is about to be displayed after the m-th row is displayed, the gates on the gate line of the second row are turned on. At this time, the charge sharing act will affect the data in the liquid crystal display panel, i.e., the data of the first row will also be neutralized to become approximately the common electrode Vcom. For a display in the normally black mode, the display effect of the second row is equivalent to black data. In this way, when the data of the first row arrives in the next frame, a black image has been displayed for a period of time with respect to this row, achieving the screen-refreshing effect, and improving the motion blur effect. From FIG. 9(*a*), the gate line selection signal is obtained as following:

$$G1 = \mathrm{OUT1} * \overline{OE} + OUTm * TP;$$

$$G2 = \mathrm{OUT2} * \overline{OE} + \mathrm{OUT}(m+1) * TP;$$

$$\ldots$$

Figure 10A:
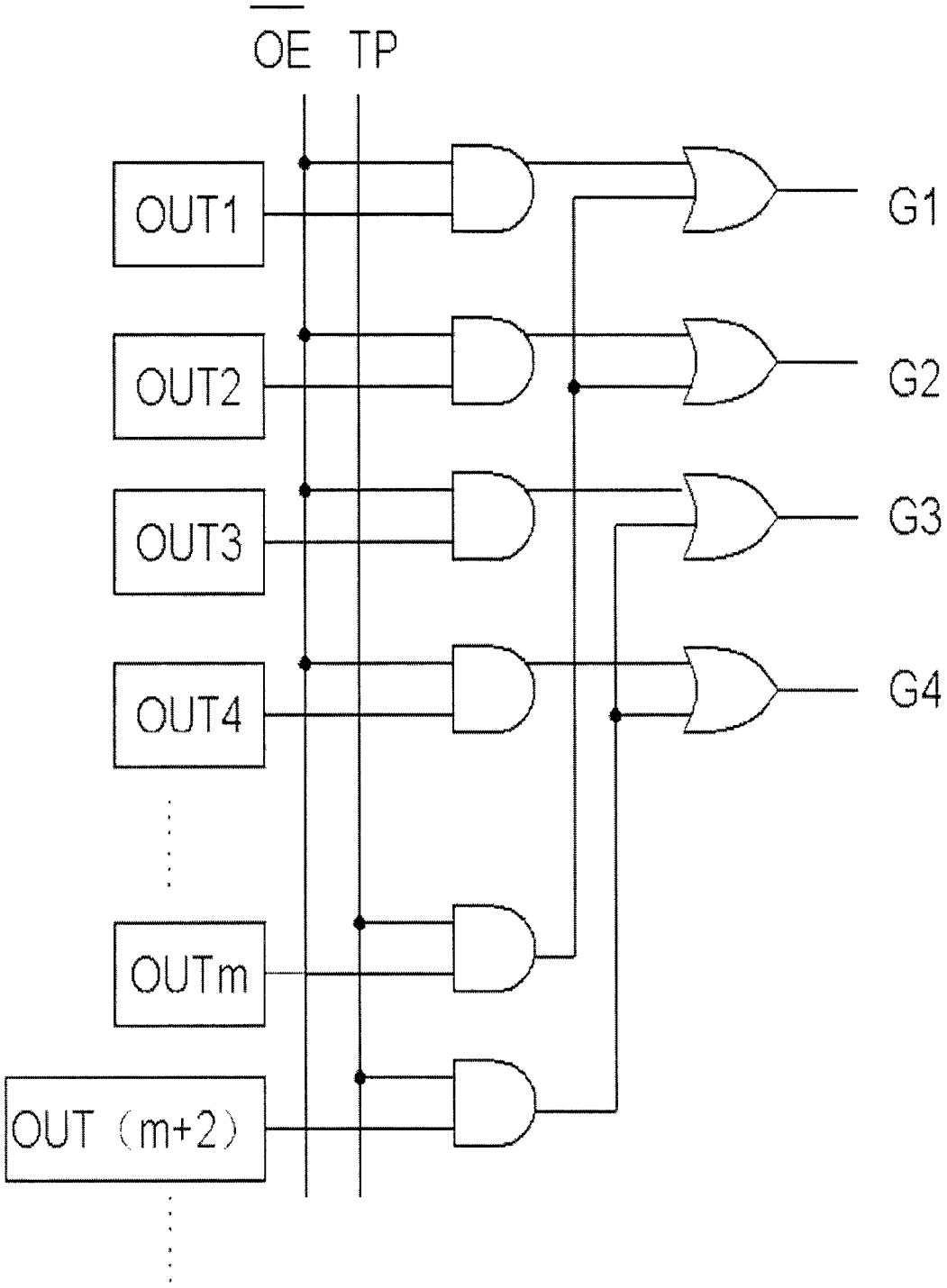
FIG. 10(*a*) is a second circuit diagram of the control device in the liquid crystal display shown in FIG. 6.
Figure 10B:
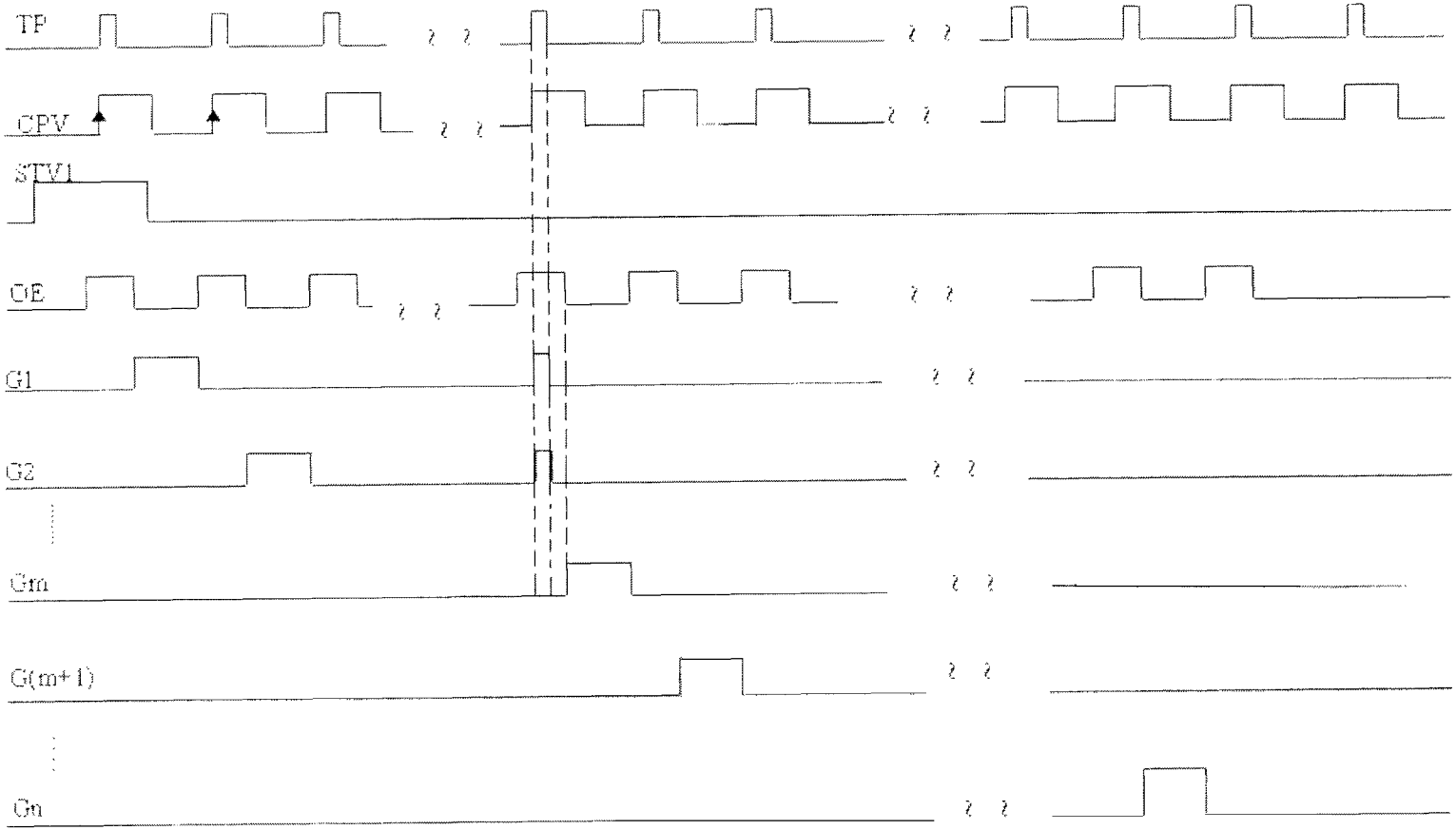

(2) As shown in FIGS. 10(*a*) and 10(*b*), the number of gate lines between the gate line of the L-th row and the gate line of the M-th row is set to be (m−1) and (m−2), wherein m>2. The detailed implementation is as follows. The gates on the gate lines of the first and the second rows are turned on before the m-th row is about to be displayed after the (m−1)-th row is displayed. At this time, the charge sharing act will affect the data of the liquid crystal display panel, i.e., the data of the first row and the second row will also be neutralized to become approximately the common electrode Vcom. For a display in the normally black mode, the display effects of the first and the second rows are equivalent to black data. In this way, when the data of the first and second rows arrives in the next frame, a black image has been displayed for a period of time with respect to the first and second rows, achieving the screen-refreshing effect, and improving the motion blur effect. Next, before the (m+1)-th row is about to be displayed after the m-th row is displayed, since the charge sharing has been conducted in the second row, such act is not needed any more. The gates on the gate lines of the third and fourth rows will be turned on before the (m+1)-th row is about to be displayed after the m-th row is displayed, and so on. The detailed timing chart is as shown in FIG. 10(*b*). From FIG. 10(*a*), the gate line selection signal is obtained as follows.

$$G1 = \mathrm{OUT1} * \overline{OE} + OUTm * TP;$$

$$G2 = \mathrm{OUT2} * \overline{OE} + OUTm * TP;$$

$$G3 = \mathrm{OUT3} * \overline{OE} + \mathrm{OUT}(m+2) * TP;$$

$$G4 = \mathrm{OUT4} * \overline{OE} + \mathrm{OUT}(m+2) * TP;$$

$$\ldots$$

It is to be noted that, in the implementation (2), the charge sharing act is conducted to gate lines of other adjacent two rows every other row. However, in a particular implementation, the charge sharing act can be conducted to gate lines of other adjacent three rows every two rows, or alternatively to gate lines of other adjacent four rows every three rows, and so on. The details will not be described here. The more the gate lines to which the charge sharing is conducted simultaneously every time, the less the logic gates it requires. On the other hand, in the implementation (2), the charge sharing act can be conducted multiple times in a particular implementation. For example, the gates on the gate lines of the first and the second gate lines are turned on for charge sharing before the m-th row is about to display after the (m−1)-th row has displayed; and the gates on the gate lines of the first and the second gate lines are turned on again before the (m+1)-th row is about to display after the m-th row has displayed. Since the TP time (i.e., the charge sharing time) is relatively short, the stored charge may not be neutralized completely in one time; therefore neutralization can be assured by conducting the charge sharing act many times.

In the above mentioned implementations (1) and (2), the BFI time t2 can be set by setting the value of m as required. The large the value of m is, the longer the keep time of the data of the last frame is, and the shorter the keep time of the black data is. Generally, the keep time of the data of the last frame should be increased as much as possible provided that the screen-blacking effect is guaranteed. Here, it can be realized by only adding one stage of logic gate circuits to the output terminal of the gate driver, and referring to the signal output from the timing controller and the gate turn-on signal output from the gate turn-on signal output terminal in the gate driver. The configuration is simple, and the purpose of improving motion blur phenomenon occurring when the TFT-LCD displays the fast moving image with a low cost is achieved.

The driving method for the liquid crystal display provided by the embodiment of the present disclosed technology is used for the liquid crystal display in the charge sharing mode, comprising:

inputting a driving voltage for turning on a gate to a gate line of the L-th row in a BFI time, which is a time when charge sharing is conducted among the data lines from the gates on the gate line of the L-th row are turned off in the current frame until they are turned on in the next frame, wherein 1<L≤N, N is the total number of the gate lines of the liquid crystal display panel, and L is an integer.

In particular, the step of inputting a driving voltage for turning on the gate to the gate line of the L-th row in the BFI time comprises:

after the gates on the gate line of the (M−1)-th row are turned off, and before the gates on the gate line of the M-th row are turned on, inputting the driving voltage for turning on the gate to the gate line of the L-th row, turning on the gate line of the L-th row, and neutralizing the source data of the L-th row of the liquid crystal display panel by charge sharing to become the common electrode voltage;

wherein, 1≤M≤N, N is the total number of the gate lines of the liquid crystal display panel, M is an integer, and the gate line of the M-th row is the gate line whose gates are turned on after the gate line of the L-th row.

The driving method for the liquid crystal display provided by the embodiment of the present disclosed technology is of a charge sharing mode, in which a charge sharing device is disposed at the source data output terminal of the source driver. It is possible for the charge sharing device to neutralize the source data output from the source data output terminal of the source driver to approximate the common electrode voltage when conducting the charge sharing act. Then, on the basis of the charge sharing mode, the gate line of each row of the liquid crystal display panel is made to conduct charge sharing in the corresponding BFI time. The source data corresponding to the gate line of each row of the liquid crystal display panel is neutralized to approximate the common electrode voltage, so that the display effect of this row is equivalent to black data. In this way, the gate line of the row has displayed a black image for a period of time when the source data corresponding to this row arrives in the next frame, thereby realizing the screen-refreshing effect and improving the motion blur phenomenon of the liquid crystal display panel.

The liquid crystal display of the charge sharing mode and the driving method therefor provided by the embodiments of the present disclosed technology can be applied in the liquid crystal display of a normally black mode.

The above are only particular implementations of the present disclosed technology. Nevertheless, the protection scope of the present disclosed technology is not limited thereto. Those skilled in the art can conceive variations or alternations easily within the technical scope disclosed by the present disclosure, and such variations or alternations should fall within the protection scope of the present disclosed technology. Therefore, the protection scope of the present disclosed technology should be defined by the claims.

What is claimed is:

1. A driving device for a liquid crystal display comprising a control device, wherein each gate line of the liquid crystal display is connected with the control device, and the control device outputs to a gate line connected thereto a first control signal for controlling gates on the gate line to be turned on at a black frame insertion timing, wherein the first control signal is obtained by supplying a gate turn-on signal to be supplied to an $M^{th}$ row of gate lines to an $L^{th}$ row of gate lines, and the black frame insertion timing is a timing at which when charge sharing is conducted among data lines at a period when gates on the $L^{th}$ row of gate lines are turned off in a current frame until they are turned on in a next frame; wherein $1 \leq L \leq N$, $1 \leq M \leq N$, $L \neq M$, N is a total number of gate lines of the liquid crystal display panel, and L and M are an integer respectively, wherein the charge sharing is conducted simultaneously to gate lines of alternating adjacent rows.

2. The driving device according to claim 1, wherein the control device comprises an AND gate, the first input terminal of which is connected to a timing controller, and the second input terminal of which is connected to a gate turn-on signal output terminal for supplying the gate turn-on signal to the $M^{th}$ row of gate lines, and the AND gate provides the first control signal to the $L^{th}$ row of gate lines according to a first timing signal input from the timing controller and the gate turn-on signal input from the gate turn-on signal output terminal.

3. The driving device according to claim 2, wherein the control device further comprises an OR gate, the first input terminal of which is connected to the output terminal of the AND gate, the second input terminal of which is connected to a output terminal for providing a second control signal to the $L^{th}$ of gate lines, and the output terminal of the OR gate is connected to the $L^{th}$ row of gate lines, wherein the second control signal controls the gates on the $L^{th}$ row of gate lines to be turned on in a charge sharing mode, and the first timing signal is a timing signal for controlling the charge sharing act.

4. A driving method for a liquid crystal display with a charge sharing mode, comprising:

inputting a driving voltage, for turning on gates, to an $L^{th}$ row of gate lines in a black frame insertion timing, which is a time at which charge sharing is conducted among data lines at a period when the gates on the $L^{th}$ row of gate lines are turned off in a current frame until they are turned on in a next frame, wherein the driving voltage is obtained by supplying a gate turn-on signal to be supplied to an $M^{th}$ row of gate lines to the $L^{th}$ row of gate lines, wherein $1 \leq L \leq N$, $1 \leq M \leq N$, $L \neq M$, N is a total number of gate lines of the liquid crystal display panel, and L and M are an integer respectively, wherein the charge sharing is conducted simultaneously to gate lines of alternating adjacent rows.

5. The driving method according to claim 4, wherein the step of inputting a driving voltage, for turning on gates, to the $L^{th}$ row of gate ones in the black frame insertion timing comprises:

after the gates on an $(M-1)^{th}$ row of gate lines are turned off, and before the gates on the $M^{th}$ row of gate ones are turned on, inputting the driving voltage, for turning on the gates to the $L^{th}$ row of gate lines, turning on the $L^{th}$ row of gate lines, and neutralizing the source data of the L-th row of the liquid crystal display panel by charge sharing to become a common electrode voltage; and wherein, the $M^{th}$ row of gate lines is a gate line whose gates are turned on after the $L^{th}$ row of gate lines.

* * * * *